US007043178B1

(12) United States Patent
Taylor et al.

(10) Patent No.: US 7,043,178 B1
(45) Date of Patent: May 9, 2006

(54) NOISE DAMPER FOR WIRE AUGER

(75) Inventors: Andrew E. Taylor, Herts (GB); Alan C R. Howard, Beds (GB); Jeremy Lewis, London (GB)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 11/011,698

(22) Filed: Dec. 14, 2004

(51) Int. Cl.
*G03G 15/08* (2006.01)

(52) U.S. Cl. ..... 399/256; 399/358; 399/359; 399/360

(58) Field of Classification Search ..... 399/359, 399/256, 360
See application file for complete search history.

(56) References Cited

U.S. PATENT DOCUMENTS

| | | | | |
|---|---|---|---|---|
| 3,636,928 | A * | 1/1972 | Sumner et al. | 119/57.3 |
| 5,510,883 | A * | 4/1996 | Kimura et al. | 399/256 |
| 5,687,297 | A | 11/1997 | Coonan et al. | 358/1.2 |
| 6,044,242 | A * | 3/2000 | Kakiwaki et al. | 399/297 |
| 6,069,624 | A | 5/2000 | Dash et al. | 715/866 |
| 2005/0002709 | A1 * | 1/2005 | Jeong et al. | 399/358 |

* cited by examiner

*Primary Examiner*—Arthur T. Grimley
*Assistant Examiner*—Crystal Wagner
(74) *Attorney, Agent, or Firm*—Oliff & Berridge, PLC

(57) ABSTRACT

An apparatus and method for dampening annoying resonance noise in auger systems. The dampening effect is accomplished by an insert placed within an inner bore of an auger. The insert itself may be continuous or in segments and be comprised of material capable of absorbing vibrational energy. One embodiment of an insert is a tube that is purposefully cut longer than the auger itself in order to induce bending of the tube and contact with the sides of the auger bore.

21 Claims, 4 Drawing Sheets

NOISE DAMPER FOR WIRE AUGER

BACKGROUND AND SUMMARY

The field of the invention pertains to augers for transporting liquids or powders and, more particularly, to a method of damping noise caused by a rotating auger.

Auger-type devices placed within cylinders or tubes are often used to move or transport powders and certain liquids. An early example is an Archimedes screw. Where the augers are large and made of rigid materials, noise is either not a problem or is ameliorated by selection of materials. Where, however, augers are made of flexible material and are small enough to flex when turned or under load, the action of turning often creates noise as the flexible auger material rubs against the containing cylinder or tube.

One exemplary application occurs in certain electrostatographic printers. In particular, toner cleaning systems require that waste toner be removed from the cleaning station and transported to a location for storage or for re-input into a toner bin for re-use. Cleaning systems typically comprise either blades or brushes, and waste toner is typically removed from such blades or brushes by vacuum, abrasion, centrifugal force, or combinations of each of these removal methods. After removal from such blades or brushes, the toner typically is carried by vacuum or gravity to the mouth of a mechanism designed to transport the waste toner to a location for reuse or for storage until removal from the system. As explained below, conventional mechanisms for transporting waste toner comprise plastic tubes with wire augers inside. Waste toner is moved along the spiraled blades of the auger during auger rotation. As the blades of the auger scrape against the surrounding plastic tube, vibrations set up resonances, and such resonances cause annoying noise emissions from the machine.

Although the exemplary application relating to waste toner augers will be used to explain embodiments of the invention, augers within cylinders or tubes are used in many other situations, and embodiments of the invention are usable in many applications. For instance, paint and ink manufacturers need to transport powdered pigments and dies when making colorant concentrates. Cosmetic manufacturers similarly move powders and may utilize auger systems. Many other industries and systems use augers to move powders and liquids.

It would be desirable to create a simple, inexpensive, and reliable means for preventing or ameliorating noises caused by the resonance of auger blades against the containment vessels into which they are placed. It would be further advantageous if such means were easily removable from the auger system during maintenance, repair, and/or replacement.

One embodiment of the present invention is an auger system, comprising: an auger member having a length and, along at least a portion of the length, an internal bore; an insert placed through at least a portion of the interior bore; and a containment member into which the auger is placed.

Another embodiment of the present invention is a process for dampening vibrational energy in an auger system, comprising: inserting an insert through an internal bore in an auger; placing the auger into a containment member; and bending the insert such that it makes contact with the internal bore of the auger.

Yet another embodiment of the present invention is an electrostatographic printer having an auger system for transporting waste toner, said auger system comprising: an auger member having a length and, along at least a portion of the length, an internal bore; an insert placed through at least a portion of the interior bore; and a containment member into which the auger is placed.

DETAILED DESCRIPTION

Figure 1:
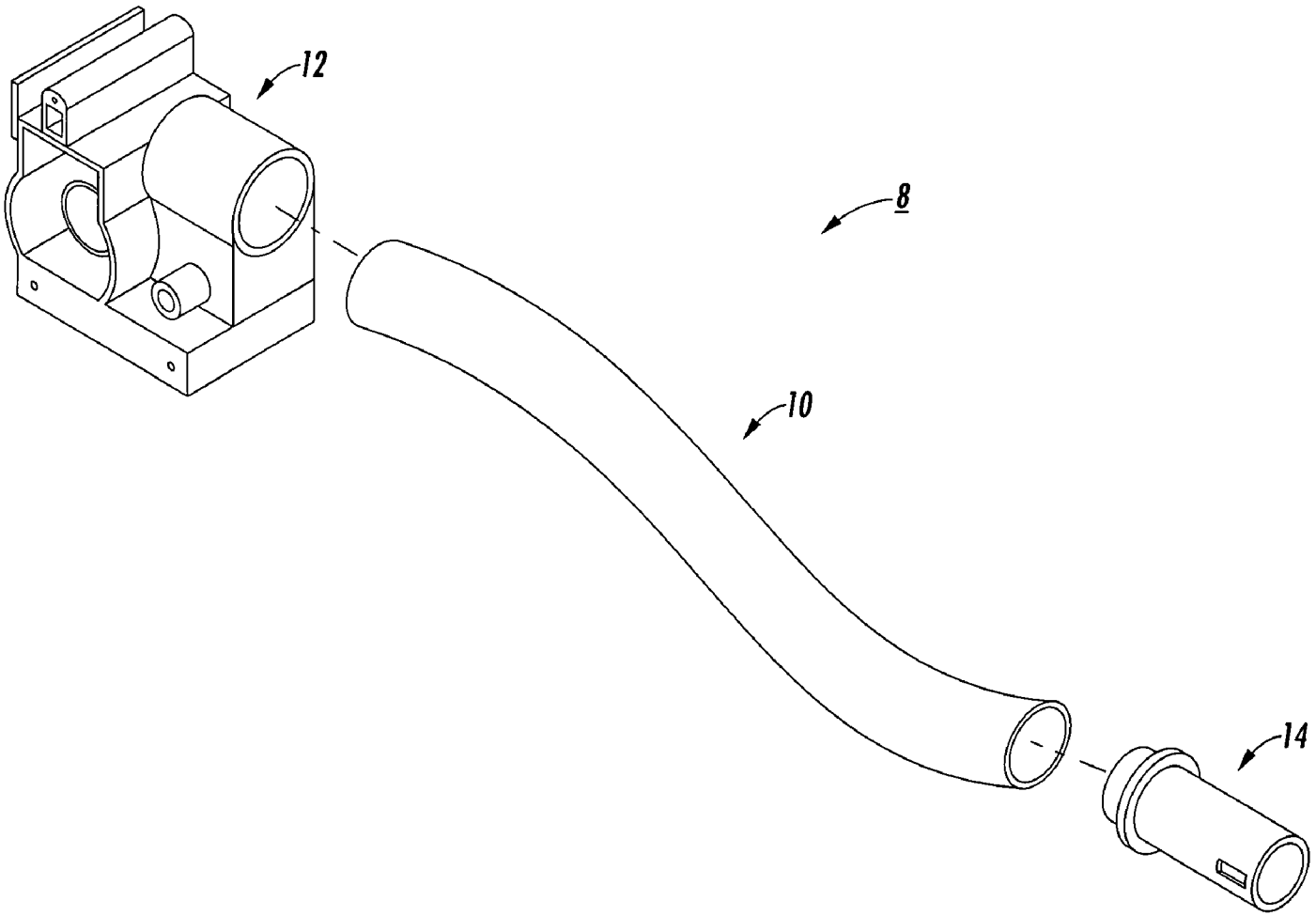
FIG. 1 PRIOR ART
FIG. 1 is a perspective view of a conventional prior art containment member for containing an auger.

For a general understanding of the present invention, reference is made to the drawings. In the drawings, like reference numerals have been used throughout to designate identical elements.

An exemplary electronic system comprising one embodiment of the present invention is a multifunctional printer with print, copy, scan, and fax services. Such multifunctional printers are well known in the art and may comprise print engines based upon ink jet, electrophotography, and other imaging devices. The general principles of electrophotographic imaging are well known to many skilled in the art. Generally, the process of electrophotographic reproduction is initiated by substantially uniformly charging a photoreceptive member, followed by exposing a light image of an original document thereon. Exposing the charged photoreceptive member to a light image discharges a photoconductive surface layer in areas corresponding to non-image areas in the original document, while maintaining the charge on image areas for creating an electrostatic latent image of the original document on the photoreceptive member. This latent image is subsequently developed into a visible image by a process in which a charged developing material is deposited onto the photoconductive surface layer, such that the developing material is attracted to the charged image areas on the photoreceptive member. Thereafter, the developing material is transferred from the photoreceptive member to a copy sheet or some other image support substrate to which the image may be permanently affixed for producing a reproduction of the original document. In a final step in the process, the photoconductive surface layer of the photoreceptive member is cleaned to remove any residual developing material therefrom, in preparation for successive imaging cycles. Residual developing material that is cleaned from the photoconductive surface is transported from the cleaning station to a waste storage sump. In typical systems, the transportation is accomplished using an auger within a tube or cylinder. Some embodiments of the present invention comprise improvements upon the tube and auger systems typically used in electrostatographic applications.

The above described electrophotographic reproduction process is well known and is useful for both digital copying and printing as well as for light lens copying from an original. In many of these applications, the process described above operates to form a latent image on an imaging member by discharge of the charge in locations in which photons from a lens, laser, or LED strike the photoreceptor. Such printing processes typically develop toner on the discharged area, known as DAD, or "write black" systems. Light lens generated image systems typically develop toner on the charged areas, known as CAD, or "write white" systems. Embodiments of the present invention apply to both DAD and CAD systems. Since electrophotographic imaging technology is so well known, further description is not necessary. See, for reference, e.g., U.S. Pat. No. 6,069,624 issued to Dash, et al. and U.S. Pat. No. 5,687,297 issued to Coonan et al., both of which are hereby incorporated herein by reference.

As described above, conventional auger systems for removing waste toner in electrostatographic printers generate noise from vibration resonances occurring as the auger coil blades rub against the confining tube or cylinder. Referring to FIG. 1, three parts of a containment member 8 are shown as parts 10, 12, and 14. Part 12 is a waste toner inlet housing for receiving waste toner that has been cleaned from a photoconductive surface. Such cleaning typically uses either blades or brushes or both. Housing 12 has a side recess for receiving and mating with curved tube 10. Tube 10, in turn, is received by and mates with a recess in a waste toner outlet part 14. An aperture in outlet part 14 allows toner to be dumped into a waste toner sump (not shown) for storage.

Figure 2:
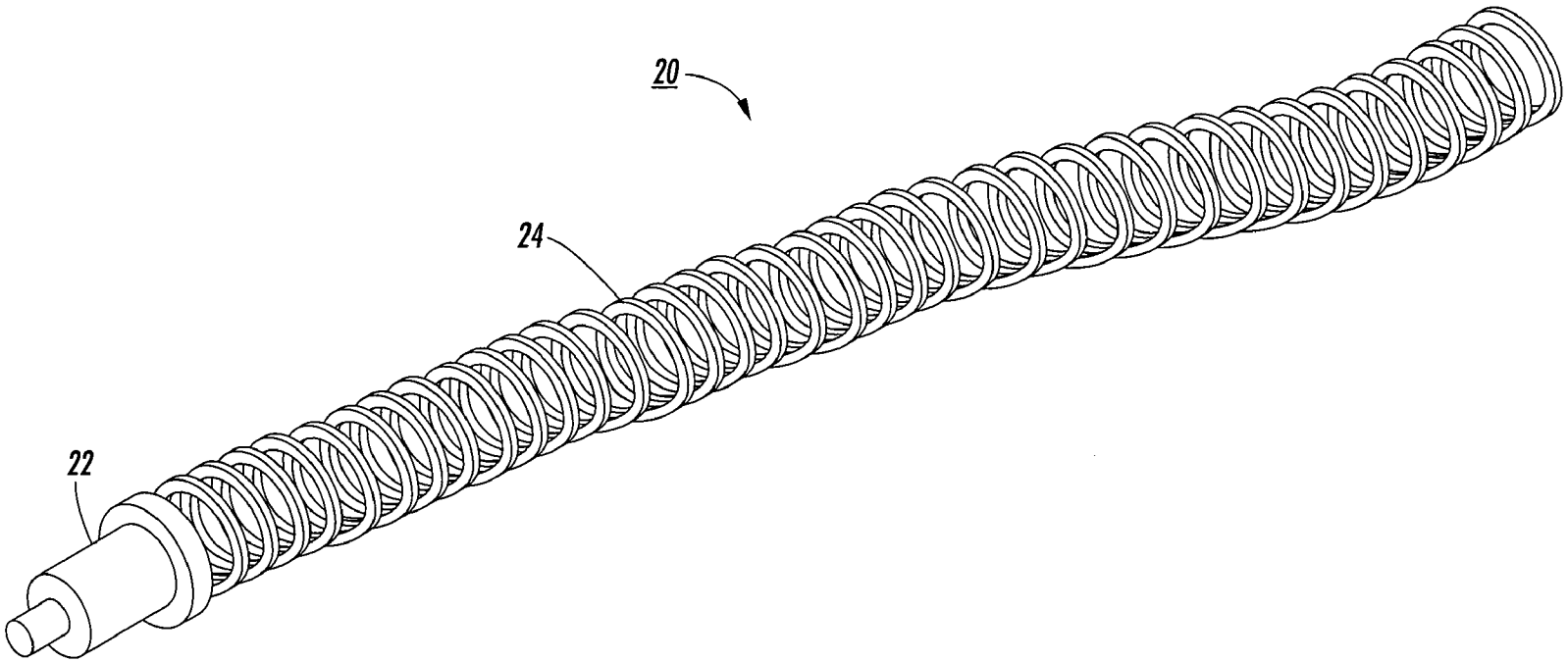
FIG. 2 PRIOR ART
FIG. 2 is a perspective view of a conventional rectangular wire form auger.

FIG. 2 shows wire auger 20 in its conventional configuration. One terminus of wire auger 20 is drive shaft 22 through which rotational energy is imparted via connections (not shown) within waste toner inlet housing 12 shown in FIG. 1. In this embodiment, the auger comprises a rectangular wire form auger 24. When removed from containment member 8, auger 24 resembles a simple spring made of rectangular-shaped wire. When rotated within containment member 8, such a spring forms an effective auger with each spiral forming a helical auger blade that urges the spent toner from one end of the containment member to the other. The second terminus of the auger ends within the waste toner outlet 14 shown in FIG. 1. When inserted into inlet housing 12, tube 10, and outlet 14, the auger works by transporting waste toner along the rotating auger blades from the inlet housing to the waste outlet. Although the embodiment shown comprises a simple rectangular wire form auger, any other flexible auger design is intended to be encompassed within the invention, including augers comprised of plastics and other flexible materials, augers with inner walls forming an enclosed bore, and augers comprised of discrete blades that are assembled in helical fashion around a central bore in order to provide the urging motion.

As discussed above, flexible augers inside containment members, including tubes and cylinders, often create resonance as portions of the auger blades scrape against the containment member and create audible frequencies that resonate between the containment member and one or more blades of the auger. The sounds may be intermittent or continual but in any event are often annoying when the device is in an office, home or other space in which such sounds can easily be heard. Although rigid augers also may create rubbing and scraping sounds, flexible augers augment such rubbing and scraping sounds by enabling the vibrations to resonate and spread within the flexible material.

Figure 3:
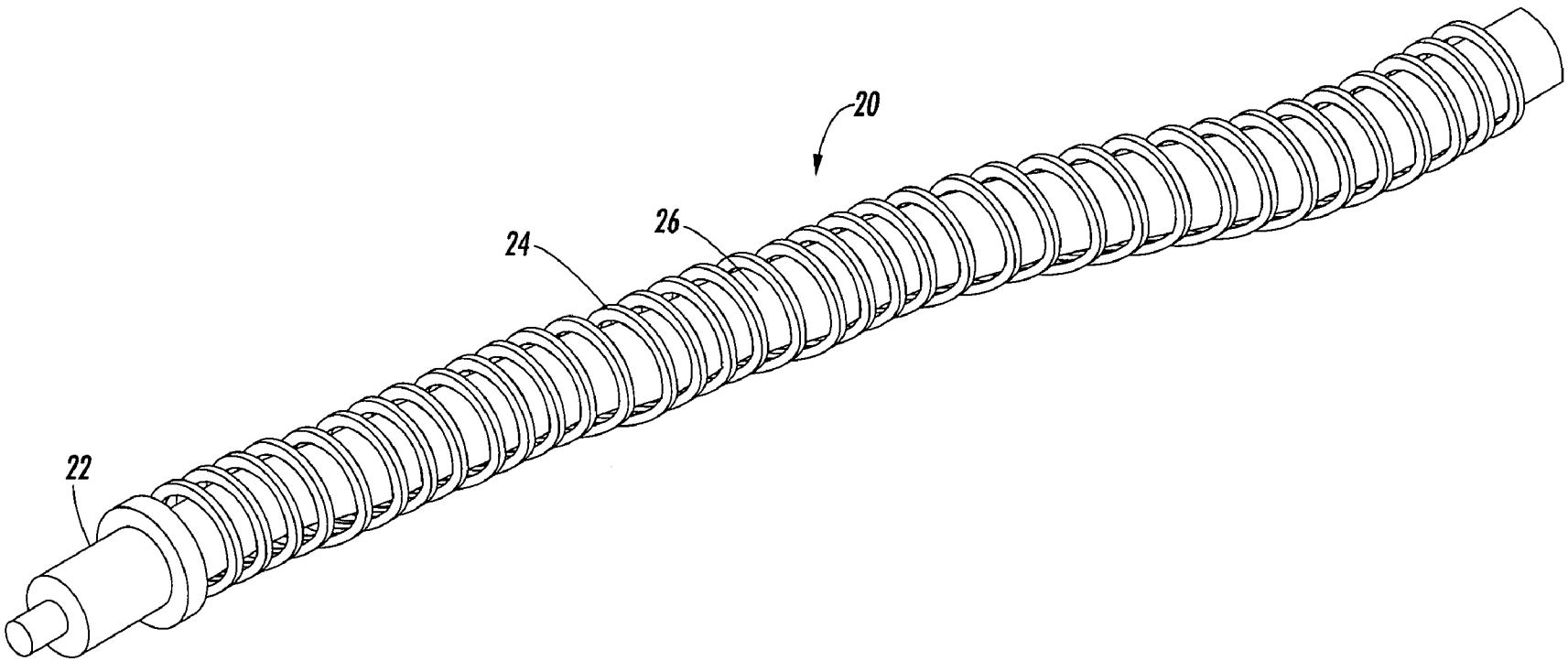
FIG. 3 is a perspective view of one embodiment of the invention wherein an insert is placed in an auger bore.

One embodiment of a solution is shown in FIG. 3. Here, an insert comprising a tube 26 has been inserted into the bore of auger 24. The purpose of the tube is for at least portions to rest against the inside of the coil blades of the auger, thereby absorbing and dampening the vibrations caused by the coil blades during contact with the containment member. A suitable insert material is one that absorbs and dampens vibrations, including, without limitation, many resilient compounds such as rubber, foam, and many plastics. One embodiment comprises a tube made of silicon rubber. Such tube material can be made relatively smooth for insertion into the auger bore, is flexible, and absorbs and dampens vibrational energy readily.

At least partial contact between the insert such as tube 26 and the sides of the auger bore are desired in order to enable vibrations to be absorbed by the insert. One method is to provide an insert that has an outside diameter almost as large as the bore of the auger. Where the auger is confined by a curved containment member as shown in FIG. 1, such method is particularly effective since the resulting curvature of the auger induces multiple points of contact between the sides of the bore and the insert. Another method is to make the insert longer than the auger itself and to compress each end. The flexible insert will, as a result, bend and assume a curved or serpentine shape within the bore. When coupled with a curved auger due to a curved containment member, an insert that is longer than the auger provides even more contact points between the sides of the bore and the insert than if the insert were the same length as the auger within the curved containment member.

Figure 4:
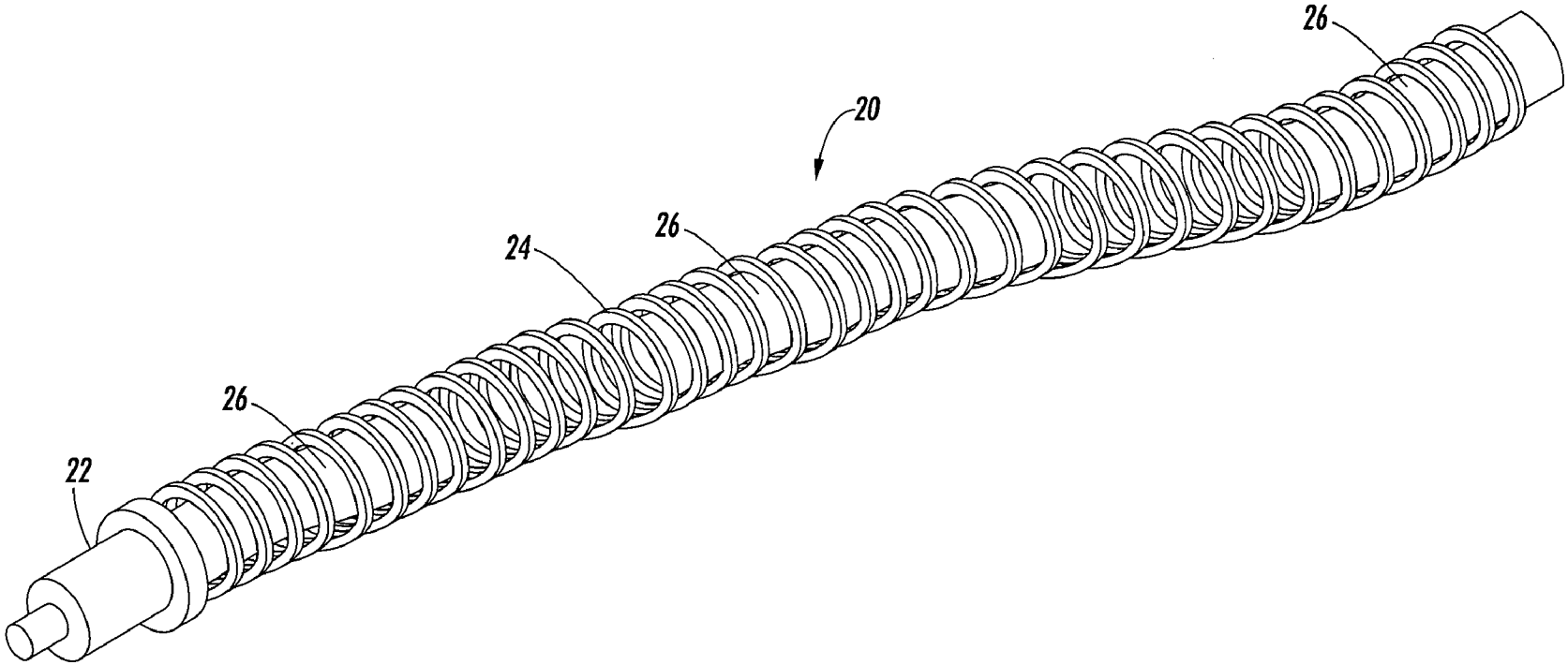
FIG. 4 is a perspective view of a second embodiment of the invention wherein an insert comprised of segments is placed in an auger bore.

An embodiment of an insert longer than the auger wherein both are contained within a curved containment member is shown in FIG. 3. Once auger 24 and tube 26 are sealed within containment member comprising inlet 12, tube 10, and outlet 14, the auger and insert are bent by the curve in tube 10. Insert 26 is additionally compressed and bent into additional contact with auger 24 since insert 26 is compressed by contact with inlet 12 and outlet 14. The result is multiple points of contact between tube 26 and auger 20. The more points of contract, the better, and contact with or near each coil blade of the auger should eliminate essentially all resonance. In other embodiments, the insert need not be continuous. As shown in FIG. 4, the insert may be comprised of segments that abut each other inside the bore or may be spaced apart within the bore but arranged such that most vibrations are damped by contact with portions of the insert(s). Where contact points between the auger and the containment member can be predicted, segments of inserts may be inserted proximate to these locations in order to dampen vibrations at the locations where they occur.

Insertion of the insert such as tube 26 in FIG. 3 is made easier if the outside diameter of the insert is significantly less than the inside diameter of the auger bore. Where the bore size is approximately 11.7 mm, an outside diameter of tube 26 of 8.2 mm is adequate for easy insertion and removal during maintenance, replacement and/or repair. The difference between the bore and OD of the tube of about 3.5 mm plus or minus 1 mm should be sufficient for easy insertion and removal while still providing sufficient contact between the tube and auger to dampen resonance vibrations. Stated a different way, a ratio between the OD of the insert and the sides of the bore of approximately 8.2/11.7, or about 0.7 plus or minus 0.2 should provide sufficient working clearance and adequate dampening action.

In sum, an apparatus and method for dampening annoying resonance noise in flexible auger systems has been shown in which the dampening effect is accomplished by an insert placed within the bore of an auger. The auger itself may be of any material although augers comprised of wire or other flexible material are expected to most often create the resonance noises to be dampened. The insert itself may be continuous or in segments and be comprised of material capable of absorbing vibrational energy. In one embodiment, the insert is a continuous tube that is purposefully cut longer than the auger itself.

While particular embodiments have been described, alternatives, modifications, variations, and substantial equivalents that are or may be presently unforeseen may arise to applicants or others skilled in the art. Accordingly, the appended claims as filed and as they may be amended are intended to embrace all such alternatives, modifications, variations, improvements, and substantial equivalents.

What is claimed is:

1. An auger system, comprising:

an auger having a length in an axial dimension of the auger and, along at least a portion of the length, an internal bore;

an elongate insert having a longer dimension, the insert placed through at least a portion of the internal bore with the longer dimension of the insert extending along the length of the auger; and a containment member into which the auger is placed, wherein the insert curves along the length dimension of the auger relative to the auger and is in contact with the internal bore of the auger.

2. The auger system of claim 1, wherein the auger is flexible.

3. The auger system of claim 1, wherein the containment member is curved.

4. The auger system of claim 1, wherein the insert comprises a plurality of segments.

5. The auger system of claim 4, wherein the auger makes contact with the containment member and wherein portions of the segments are placed proximate to points at which the auger contacts the containment member.

6. The auger system of claim 1, wherein the auger has an end and wherein a portion of the insert extends beyond the end.

7. The auger system of claim 1, further comprising:

a first terminus of the auger located at a first end of the length of the auger; and a second terminus of the auger located at a second end of the length of the auger, wherein the insert has a length that is longer than the length of the auger, the insert comprising:

a first insert end located at a first end of the insert, and a second insert end located at a second end of the insert, wherein the first insert end and the second insert end are fixed at the first terminus and the second terminus, respectively, and an entire length of the insert resides within the inner bore of the auger.

8. The auger system of claim 1, wherein the insert comprises a tube.

9. The auger system of claim 1, wherein the insert comprises a resilient material.

10. The auger system of claim 1, wherein the insert comprises silicon rubber.

11. The auger system of claim 1, wherein the auger comprises a wire form auger.

12. The auger system of claim 1, wherein the auger comprises an auger having spiral blades with a rectangular cross-section.

13. The auger system of claim 1, wherein the auger comprises a spiraled blade and wherein, during operation, portions of the insert are in contact with most of the spirals.

14. The auger system of claim 1, wherein the auger system comprises a portion of a system for transport of waste toner within a printing system.

15. The auger system of claim 1, wherein the insert has an outside dimension and the internal bore has an inside dimension and wherein the ratio between the outside dimension of the insert and the inside dimension of the bore is approximately 0.7 plus or minus 0.2.

16. The auger system of claim 1, wherein the insert has an outside dimension and the internal bore has an inside dimension and wherein the difference between the outside dimension of the insert and the inside dimension of the bore is about 3.5 millimeters plus or minus 1 millimeter.

17. The auger system of claim 1, wherein the insert is removable from the auger bore.

18. A process for dampening vibrational energy in an auger system, comprising:

inserting an elongate insert along a length dimension of an auger through an internal bore in the auger, the length dimension extending in an axial dimension of the auger, a longer dimension of the insert extending along the length of the auger;

placing the auger into a containment member; and making contact between the insert and the internal bore of the auger by compressing at least one end of the insert along the length dimension of the auger, wherein making the contact comprises:

curving the insert in the length dimension of the auger relative to the auger, and keeping the insert in a curved shape relative to the auger.

19. The process of claim 18, further comprising compressing the insert along its length dimension in order to induce bending.

20. An electrostatographic printer having an auger system according to claim 1 for transporting waste toner.

21. An auger system, comprising:

an auger having a length extending in a longitudinal dimension of the auger and, along at least a portion of the length, an internal bore that extends along the longitudinal dimension of the auger;

an elongate insert placed through at least a portion of the internal bore, the insert extending along the longitudinal dimension of the auger, wherein at a cross section through the auger and the insert, a longitudinal axis of the insert is non-parallel with a longitudinal axis of the auger; and a containment member into which the auger is placed.

* * * * *